United States Patent [19]

Gartner et al.

[11] 4,328,854

[45] May 11, 1982

[54] CASTING CORE FOR AN INTAKE PIPE ASSEMBLY FOR AN INTERNAL COMBUSTION ENGINE

[75] Inventors: Jurij Gartner, Germering; Helmut Hengl; Karl Sixt, both of Munich; Reinhard Woltmann, Puchheim, all of Fed. Rep. of Germany

[73] Assignee: Bayerische Motoren Werke A.G., Munich, Fed. Rep. of Germany

[21] Appl. No.: 131,849

[22] Filed: Mar. 19, 1980

Related U.S. Application Data

[62] Division of Ser. No. 885,977, Mar. 13, 1978, Pat. No. 4,228,769.

[30] Foreign Application Priority Data

Mar. 15, 1977 [DE] Fed. Rep. of Germany ..... 2711195

[51] Int. Cl.[3] ..... B22C 9/10

[52] U.S. Cl. ..... 164/369

[58] Field of Search ..... 164/365, 368, 31, 32, 164/369, 137; 249/184; 123/52 M, 139 AW

[56] References Cited

U.S. PATENT DOCUMENTS 1,802,024 4/1931 Kreis ..... 123/52 M
3,374,827 3/1968 Schebler ..... 164/137

OTHER PUBLICATIONS

*Basic Cams, Valves and Exhaust Systems,* No. 2, Petersen Publishing Co., 1971, p. 157.

*Primary Examiner*—Gus T. Hampilos
*Attorney, Agent, or Firm*—Craig & Antonelli

[57] ABSTRACT

A casting core for an intake pipe assembly for an in-line four to six cylinder internal combustion engine. Core parts for each two similar individual intake pipes form, together with the core parts for the intermediate part of the intake manifold, an integral core segment. The core segments are permanently connected to one another in a vicinity of their core parts for the intake manifold.

1 Claim, 3 Drawing Figures

CASTING CORE FOR AN INTAKE PIPE ASSEMBLY FOR AN INTERNAL COMBUSTION ENGINE

This is a division of application Ser. No. 885,977, filed Mar. 13, 1978, now U.S. Pat. No. 4,228,769.

BACKGROUND AND SUMMARY OF THE INVENTION

The present invention relates to a casting core and, more particularly, to a casting core apparatus for manufacturing an intake pipe assembly, for internal combustion engines of the type including four to six cylinders arranged in line or the like, which core includes core segments for an intake manifold and for individual intake pipes, whereby initial sections of the individual intake pipes, with different curvatures, emerge from the intake manifold, approximately in a single plane, located in pairs opposite one another. The individual intake pipes having connecting ends in their terminal sections which are connectable to the intake ports of the engine. The terminal sections extend approximately parallel to one another and approximately at right angles to the initial sections of the individual intake pipes.

The manufacturing of a core for casting an intake pipe assembly for an internal combustion engine requires considerable effort due to the complex shape of the intake pipe assembly. Therefore, such manufacturing is relatively expensive.

The goal of the present invention resides in providing a casting core of the type described hereinabove which is both simple and economical to manufacture.

The above-noted goal of the invention is accomplished according to the invention by forming the core parts for each two similar individual intake pipes together with the core part for the intermediate part of the intake manifold as an integral core segment and permanently connecting the core segments to one another in a vicinity of their core parts for the intake manifold.

These and further objects, features and advantages of the present invention will become more apparent from the following description when taken in connection with the accompanying drawings which show, for purposes of illustration only, one embodiment in accordance with the present invention.

DETAILED DESCRIPTION OF THE DRAWINGS

To demonstrate the complex shape of a casting core for an intake pipe assembly, which necessarily creates difficulties in the manufacturing of such core, an intake pipe assembly for a six cylinder fuel-injected in line engine (not shown) designed to operate as an "Otto" engine will be described first.

Figure 1:
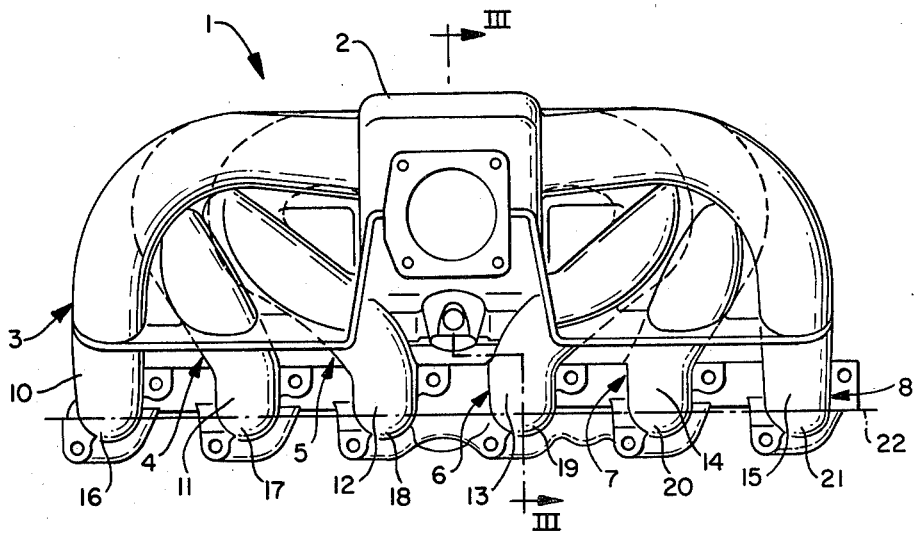
FIG. 1 is a front view of an intake-pipe assembly for a six-cylinder in-line internal combustion engine, constructed in accordance with a preferred embodiment of the invention.
Figure 2:
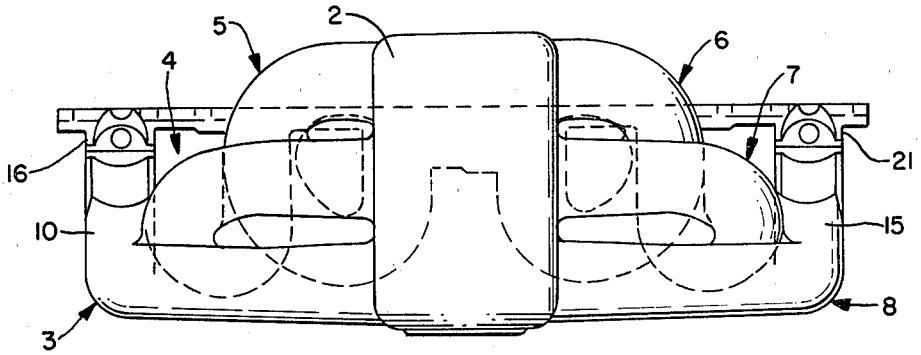
FIG. 2 is a top view of the intake-pipe assembly according to FIG. 1.

More particularly, as shown in FIG. 1, an intake-pipe assembly generally designated by the reference numeral 1, an intake manifold 2 and six individual intake pipes generally designated by the reference numerals 3, 4, 5, 6, 7, and 8. The individual intake pipes emerge in a plane 9, (FIG. 3), parallel to one another and pairwise opposite from intake manifold 2, and are of equal length. They are provided with curved overlapping intermediate segments 10, 11, 12, 13, 14, and 15, and are provided with connecting end portions 16, 17, 18, 19, 20 and 21, which can connect them to the inlet channels of an internal combustion engine, said connecting end portions extending approximately parallel to one another in a plane 22. The connection at the manifold is along a plane which extends substantially at right angles to the connection plane at the engine. The inside cross section of the individual intake pipes 3 to 8 is circular and decreases from intake manifold 2 to connecting ends or end portions 16 to 21. Intake manifold 2 is mounted approximately at right angles to the connecting ends 16 to 21. The curved intermediate segments 10 to 15 of the individual intake pipes 3 to 8 run so that, the connecting ends 18 and 19 of pipes 5 and 6 are located immediately side by side in the middle of the row of connecting ends 16 to 21. The sequency of the connecting ends 18, 17, 16 and 19, 20, 21, starting from the middle of the row of connecting ends, corresponds to the sequence of the outlets of the individual intake pipes 3 to 8 from intake manifold 2. This means that the two central connecting ends 18 and 19 are associated with the two individual intake pipes 5 and 6, extending out from intake manifold 2 on the side (upper side of FIG. 2 illustration) of connecting ends 16 to 21, while the two outer connecting ends 16 and 21 are associated with the two individual intake pipes 3 and 8, which extend out from the side (bottom side of FIG. 2 illustration) of intake manifold 2 which is opposite connecting ends 16 to 21. The two additional individual intake pipes 4 and 7 which emerge from intake manifold 2 between the above-mentioned individual intake pipes 3 and 5 and 6 and 8 make a transition to the connecting ends 17 and 20 which are located between the respective middle and outer connecting ends 16 and 18 and 19 and 21. The curved intermediate segments 12 and 13 of individual intake pipes 5 and 6 connected with the middle connecting ends 18 and 19 are initially bent away from connecting ends 16 to 21 and then bent back toward the latter (best illustrated in FIG. 3).

Intake-pipe assembly 1 can be manufactured as a one-piece casting. For this reason it is designed so that it is relatively easy and simple to shape and free of undercuttings.

Figure 3:
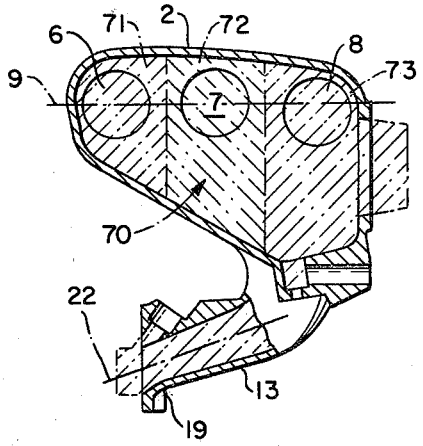
FIG. 3 is a cross sectional view along line III—III in FIG. 1 with casting core features schematically illustrated.

The casting core generally designated by the reference numeral 70, shown in FIG. 3 by dash-dot lines and dash-dot shaded areas, for casting the intake-pipe assembly 1 consists of three core segments 71, 72, 73, interlocking with each other in the vicinity of intake manifold 2 and connected together two-dimensionally. Each of these core segments 71, 72, 73, consists of one core part for the intake manifold and two core parts for each two individual intake pipes 5 and 6, 4 and 7, or 3 and 8, emerging opposite one another from intake manifold 2. This division allows core 70 to be manufactured relatively simply and economically. Moreover, a casting skin or flash may form at certain points in the intake manifold, and the flow will not be disadvantageously influenced by the casting skin or flash.

The intake-pipe assembly 1 disclosed and described above can be modified, according to other contemplated preferred embodiments of the invention, especially for five- and four-cylinder in-line internal combustion engines, in simple fashion by eliminating one or two of the outer individual intake pipes. Then both the pattern of the individual intake pipes and the position of the intake housing relative to the connecting ends can be varied considerably by parallel displacement and/or swiveling around the above-mentioned intersecting axes of the planes of the intermediate segments, in accordance with the individual spatial requirements within the scope of the invention. In the case of engines with carburetors, it is merely necessary to adapt the intake manifold to accept the carburetor connections. The ends of the individual intake pipes 3-8, extending out from the intake manifold 2, within the scope of the invention, may be in a triangular arrangement instead of being in a plane 9 in a manner more fully described in U.S. patent application Ser. No. 885,977, now U.S. Pat. No. 4,228,769 issued Oct. 21, 1980, so as to permit an even lower structural height for the intake manifold 2 and hence for the entire intake-pipe assembly 1.

While we have shown and described only one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Casting core apparatus for manufacturing an intake-pipe assembly, for internal combustion engines of the type including four to six cylinders arranged in line or the like, having:

an intake manifold, and a plurality of intake pipes opening into one side of said intake manifold at respective manifold end segments of said intake pipes, each of said intake pipes including a connecting end segment having an extreme end portion attachable to inlet channel means of an engine and a curved intermediate segment interconnecting the respective manifold end segments and connecting end segments, wherein said intermediate segments overlap one another and extend in respective intermediate segment planes, said intermediate segment planes being angularly inclined with respect to one another and intersecting with one another near a common intersection area for said intermediate and connecting end segments, wherein a plurality of intake pipes are disposed at a second side of said one side of said intake manifold, said intake pipes at said second side being similar to, and arranged pairwise symmetrically with respect to, the intake pipes at said one side, the improvement comprising:

a core part for the intermediate part of the intake manifold, core parts for each pair of two similar individual intake pipes forming together with the core part for the intermediate part of the intake manifold, an integral core segment, the core segments being permanently connected to one another near their core parts for the intake manifold.

* * * * *